United States Patent [19]

van Schaik

[11] 4,369,233

[45] Jan. 18, 1983

[54] PROCESS TO APPLY A PROTECTING SILICON CONTAINING COATING ON SPECIMEN PRODUCED FROM SUPERALLOYS AND PRODUCT

[75] Inventor: Teunis van Schaik, Velden, Netherlands

[73] Assignee: Elbar B.V., Industrieterrien "Spikweien", Lomm, Netherlands

[21] Appl. No.: 59,032

[22] Filed: Jul. 19, 1979

[30] Foreign Application Priority Data

Jul. 21, 1978 [NL] Netherlands ..... 7807798

[51] Int. Cl.[3] ..... B32B 15/00; C23C 5/00

[52] U.S. Cl. ..... 428/678; 51/320; 428/641; 428/660; 428/679; 428/680; 427/253; 427/271; 427/349; 427/350; 427/380; 427/405; 427/419.7

[58] Field of Search ..... 427/253, 252, 250, 271, 427/248 E, 331, 377, 350, 349, 348, 355, 367, 376 G, 376 C, 376 H, 376 A, 405, 419.7, 328, 380; 428/630, 641, 680, 660, 679; 51/320; 422/255.1

[56] References Cited

U.S. PATENT DOCUMENTS

| | | | |
|---|---|---|---|
| 2,683,305 | 7/1954 | Goetzel | 427/367 |
| 3,015,579 | 1/1962 | Commanday et al. | 428/641 |
| 3,015,880 | 1/1962 | Stephenson | 427/350 |
| 3,047,419 | 7/1962 | Yntema et al. | 427/255.1 |
| 3,061,463 | 10/1962 | Samuel | 427/252 |
| 3,071,491 | 1/1963 | Hom et al. | 427/350 |
| 3,129,069 | 4/1964 | Hanink et al. | 428/678 |
| 3,262,187 | 7/1966 | Allen et al. | 428/641 |
| 3,293,069 | 12/1966 | Bradley et al. | 428/641 |
| 3,904,382 | 9/1975 | Beltran et al. | 428/680 |
| 4,034,142 | 7/1977 | Hecht | 427/250 |
| 4,040,870 | 8/1977 | Holzl | 427/253 |
| 4,156,042 | 5/1979 | Hayman et al. | 427/253 |

FOREIGN PATENT DOCUMENTS

| | | | |
|---|---|---|---|
| 1771599 | 1/1973 | Fed. Rep. of Germany | 428/680 |
| 6408652 | 2/1965 | Netherlands | 428/641 |
| 722797 | 2/1955 | United Kingdom | 427/253 |

OTHER PUBLICATIONS

"Ion Plating," Tribology International, Dec. 1975, pp. 247-251.

*Primary Examiner*—Michael H. Lusignan
*Assistant Examiner*—S. L. Childs
*Attorney, Agent, or Firm*—Oblon, Fisher, Spivak, McClelland & Maier

[57] ABSTRACT

This invention is concerned with a process for applying a protecting silicon-containing coating on a superalloy. The invention further concerns the thus obtained specimens having a protective coating.

10 Claims, No Drawings

PROCESS TO APPLY A PROTECTING SILICON CONTAINING COATING ON SPECIMEN PRODUCED FROM SUPERALLOYS AND PRODUCT

In general a super alloy is an alloy based on nickel, cobalt, or iron, which alloy besides the basic elements also contains an amount of chromium, titanium, aluminum and some other elements. For a general description of super alloys reference is made to Metals Handbook, 8th edition, volume 1 page 37, published by American Society for Metals, Metals Park, Novelty, Ohio, U.S.A. From such alloys several specimens can be produced, especially parts for the heat section of gas turbines. Such parts are very resistant to corrosion and erosion occurring at high buring temperatures as well as proof against the noxious compounds present in the fuel such as sulphur, which compounds can react with these parts. The resistance against such corrosion can still be improved by applying on such parts or specimens a coating especially, a silicon-containing coating, which is applied on the parts being produced from such superalloys. Under the circumstances in which these parts are used, especially at the high temperature, silicon, however, diffuses into the superalloy after some time, by which process the protective coating disappears.

According to U.S. Pat. No. 3,129,069 a solution for such a problem is found by applying an aluminum-containing coating on the above-mentioned parts which are to high temperature, when these parts have to be used at higher temperatures than the specimen which contains a silicon coating. It is possible with an aluminum-containing coating to prevent the oxidation of gas turbines being used in an engine of an aeroplane, while the parts on which a silicon-containing coating is applied, up till now, are used on spots where fuels are used containing more impurities than are present in fuel for an aeroplane, especially sulphur and vanadium. With the coating according to this invention it has been proven to be possible to obtain an improved protection in regard with the silicon coating and besides this a more general coating is obtained that can be used instead of the aluminum-containing coating. In regard to the known silicon-containing coatings, having the disadvantage that they are more or less brittle, so that they are less stable in the mechanical point of view, it is possible now to obtain a more ductile coating.

This is possible now by using a process according to the invention for applying a protective silicon-containing coating on specimens, produced from super alloys, which are, subject to corrosion, especially corrosion at higher temperatures, characterized in that a coating comprising at least two elements, being able to form a compound with one or more of the alloy elements is applied by:

(a) applying a first layer comprising at least one of the elements chosen from the group consisting of Y and the elements from the sub groups 4A, 5A or 6A of the Periodic Table, (b) heating the specimen with the first layer to a temperature of 800°-1300° C. under a protecting atmosphere, (c) removing the phase rich in the element mentioned under (a) being that part containing more than 25 weight % thereof and (d) applying silicon on the first layer.

The elements given under (a) can be Y, Ti, Zr, Hf, V, Nb, Ta, Cr, Mo and W. From these elements Ti is preferably used. In the further description reference is made to the use of titanium, although it will be clear that one may also use one or more of the other elements. Besides this, in the further description reference is made to a super alloy on the base of nickel, although one may also use superalloys on the base of iron and cobalt.

In general, supplying a titanium-containing first layer on a specimen from an alloy, before applying a protecting silicon containing glaze layer is known from Dutch patent application No. 6408652. The process as described in that patent application is directed to the coating of the specimen from a niobium-containing alloy and it has to be underlined that from this patent application no special heat treatment under the protective atmosphere is known.

Applicant made experiments with several super alloys such as alloys being known in the trade under the indication Inconel 738C, Incolnel 738 LC and Udimet 500. These alloys have a nickel base and comprise besides nickel, chromium, cobalt, titanium and aluminum in an amount of 1-20% and zirconium, carbon, niobium and borium in an amount smaller than 1%.

The titanium layer can be coated in several ways. The most desirable method of application is dependent on the structure of the specimen that has to be coated and on the field in which the specimens is used. For specimen having an irregular structure the "ion-plate" process gave good results, because herewith the total surface of the specimen that had to be treated can be coated in a regular way. For further information in connection with ion-plating reference is made to "Tribology International" December 1975, pages 247-251. Applicant also applied titanium coatings through "pack-coating". An example of a "pack-coating" process is mentioned in the book "The Basic Principles of Diffusion Coating," Academic Press, London-New York, 1974, pages 106-108. Besides these two processes the elements can also be applied through another process, i.e., applying through the vapour phase, which can be done in a chemical or physical way; or by using a powder and slurry-coat-process; applying through a salt bath with or without an external potential; through solder coating; or by isostatically applying a substance under a high pressure and high temperature.

According to the invention titanium is preferably applied through "pack-coating" or through "ion-plating" and especially through "ion-plating".

After the titanium layer is applied on the super alloy, the specimen with the titanium layer is brought under a high temperature between 800° and 1300° C. in a protective atmosphere. By this treatment under a high temperature the titanium diffuses into the alloy for a thickness of some tens of microns. This heat treatment occurs during some hours in a protective atmosphere, preferably under high vacuum. This heat treatment also can be carried out under a reducing atmosphere or inert atmosphere. The time during which this heat treatment is carried out is dependent on the followed diffusing process and dependent on the composition of the alloy. Generally, the heat treatment is carried out during a period of within 24 hours. It is preferred to carry out the heat treatment in such a vacuum that the pressure is as low as possible, because by doing so the possibility that impurities are caught is smaller. A practical vacuum is about $10^{-7}$ mbar. In case less severe requirements are made for the coating, one can carry out a heat treatment in a protected, reducing, possibly inert atmosphere, for which it is of special importance that no oxygen is present in the inert gas, because with oxygen under these circumstances oxides can be formed, which is a disadvantage for the coating.

Preferably the treatment is carried out at a temperature between 1000° and 1200° C.

Before coating a specimen of a super alloy it sometimes is advisable to give the specimen a heat treatment, the so called solute-annealing. It appeared to be possible now to omit the solute-annealing, that normally is carried out before applying the coating, because the heat treatment that is carried out within the scope of the invention after that the titanium is applied, can take over the function of the solute-annealing.

After that titanium is diffused into the alloy the heat treatment is ended by quenching the specimen, such as is usual for solute-annealing, by which the homogeneous material structure is fixed and in this way a metastable lattice is obtained. Because of the fact that one works mostly with such an excess of titanium that the outer layer contains an excess of titanium, this layer is removed so that an outer layer is obtained containing less than about 25 weight % titanium. The removal of the excess of titanium can take place because the desired effect of the coating is obtained by the titanium diffused into the super alloy. The removal of the titanium rich phase is preferably carried out by blasting with alumina-grit. The part of the titanium containing layer having more than 25 weight % Ti is brittle and can easily be removed by blasting.

After that the specimen that has to be coated contains the titanium phase, the protecting silicon layer is applied. The application of silicon can again be carried out in several ways especially the processes mentioned above for applying titanium. Preferably silicon, is applied through "pack-coating". For "pack-coating" the specimen that has to receive the coating is placed in a container in which the material that has to be applied is present in the form of granules. Besides the material that has to be applied, being in this instant the silicon, a halide containing activator is used which is vaporous under the process-circumstances; as well as a refractory oxide to prevent agglomeration of the metallic compounds. As a refractory oxide $Al_2O_3$ is preferably used, and, besides this, as the halide containing activator Naf, $CaF_2$, NaCl and comparable compounds or a combination thereof. The temperature of the contents of the container is brought to 800°-1000° C. Below a temperature of about 800° C. it is difficult to start the process, while above 1000° C. the thickness of the layer of silicon gets irregular and thick. Preferably the thickness of the applied silicon layer is about 100 microns. The duration of such a "pack-coating"-process is 1-2 hours.

After applying the silicon the specimen can undergo an aging-treatment that can be carried out at a temperature of about 845° C. during 24 hours for the alloy Inconel 738. Such an aging treatment is preferably carried out in a protecting atmosphere. By this aging treatment a number of precipitates are separated and this gives further the desired structure. Besides this, the aging treatment gives a further stabilisation of the coating. The question if one has to carry out such an aging treatment or not is mainly dependent on the composition of the super alloy. After having carried out the above mentioned treatments a protecting layer is obtained in and on the specimen made from the super alloy and such a protecting layer is built up from compounds as titanium, silicon and mostly the basic material of the alloy, for example, nickel. By this an essential point of difference is obtained with the coatings that have been applied up till now, because these coatings mostly comprise a single layer or are composed of a number of layers applied to the alloy without forming a metal compound in that way obtained now by the process of the invention. It is found that it is of special importance that ternary silicides are formed of the G-phase, which G-phase concerns the compositions that in general can be indicated as $A_6B_{16}Si_7$, for which A is the metal, such as Ti, and, B can be nickel. The G-phase being preferably present for the above mentioned examples is $Ti_6Ni_{16}Si_7$. Besides the G-phase in the ternary system comprising nickel, titanium and silicon, $Ni_{49}Ti_{14}Si_{37}$, $NiTiSi_2$ or NiTiSi may be present.

From the further experiments that have been carried out, especially the corrosion test, it appeared that the specimen having a titanium-silicon-coating are more resistant against corrosion than specimen just having a silicon-layer or having an aluminum coating. Besides this, it appeared that a specimen having a titanium-silicon layer, for which the titanium is applied through ion-plating and silicon through pack-coating is most preferred as compared with a specimen for which titanium as well as silicon is applied through pack-coating.

Although the invention is not restricted to a certain theoretical consideration it seems to be acceptable that the good protective action of the coating applied according to the process of the invention is obtained by the fact that the silicon is firmly fixed in the metallic composition of the G-phase and by this it does not or hardly diffuse into the alloy under the circumstances in which the specimen is used. Previously the protecting silicon coating was lost after some time under the circumstances in which the specimen is used by the diffusion of silicon into the alloy. By the process of the invention and with the thus obtained coating it is possible to obtain specimens that under severe corrosive circumstances, such as high temperature, can be used for longer times than previously possible. This is of special importance for parts from the heat section of gas turbines, although the invention is not restricted to such parts. The invention is further clarified by the following example.

EXAMPLE

A part of a blade of a gas turbine having a weight of 1 kg and produced from a super alloy, Inconel 738 C, is cleaned in a mechanical way and then a coating is applied according to the invention. To do so titanium is applied on the super alloy by the ion-plate-process. For the apparatus used for this process, reference is made to "Tribology International," December 1975, page 247. The vacuum room in which the subject, made from the super alloy, is placed, is filled with argon to a pressure of $10^{-3}$ mbar and in the room a titanium wire is fixed, that can glow so that titanium is exchanged to the specimen that has to be treated. After 10 minutes such an amount of titanium is applied on the specimen, that this specimen is covered with a titanium layer in a thickness of 10 microns. Then the specimen is placed in a container that can be brought under a lower pressure, i.e., a low pressure of $10^{-7}$ mbar, and in which the specimen having the titanium coating can be brought to a temperature of 1120° C. This temperature is maintained during 2 hours after which the specimen is rapidly cooled to room temperature in the container.

Then the superfluous amount of titanium is removed from the specimen by blasting with $Al_2O_3$. By the blasting the brittle part of the titanium containing phase is removed, so that on the surface a coating remains having less than 25 weight % titanium.

Finally the specimen having the titanium layer is brought into a container filled with $Al_2O_3$, Si, NaF and $CaF_2$ in the following amounts, 75% $Al_2O_3$, 10% Si, 9% NaF and 6% $CaF_2$. This container is brought to a temperature of 850° C. and this temperature is maintained during 2 hours. After that the specimen is removed from the containers and samples are taken from the coating of the specimen and these samples are examined through a microscope. From X-ray-diffraction pictures and X-ray-micro examination it appeared that the coating mainly consists of a mixture of metal compounds of nickel, titanium and silicon, in which mainly the G-phase is present being $Ni_{16}Ti_6Si_7$ and traces of the $\epsilon$-phase (NiTiSi) and the $\tau_3$-phase being $Ni_{49}Ti_{40}Si_{37}$.

From corrosion experiments carried out by an electrochemical process it is proved that after 1900 hours the specimen, treated as mentioned above, is hardly corroded.

I claim:

1. A process for applying a protective silicon-containing coating on a super alloy, subject to high temperature corrosion, comprising:

(a) applying a first coating layer to said super alloy, said first coating layer comprising at least one of the elements selected from the group consisting of Y, Ti, Zr, Hf, V, Nb, Ta, Cr, Mo and W;

(b) heating the so-formed coated super alloy to a temperature of 800°-1300° C. under a protecting atmosphere;

(c) removing the phase rich in the elements set forth in step (a), wherein the phase rich in the elements set forth in step (a) contains more than 25 weight % thereof;

(d) applying a silicon layer to the product of step (c); and (e) heating the product of step (d) to a temperature of 800°-1000° C.

2. The process according to claim 1, wherein said first coating layer is Ti.

3. The process according to claim 2, wherein said first coating layer of Ti is applied by the ion-plating process.

4. The process according to claim 3, wherein the heating of step (b) is carried out under decreased pressure.

5. The process according to claim 4, wherein the decreased pressure is a vacuum of $10^{-5}$ to $10^{-12}$ mbar.

6. The process according to claim 1, wherein the temperature treatment of step (b) is carried out near to one of the temperatures of the heat treatment of the super alloy.

7. The process according to claim 1, wherein the phase rich in the elements set forth in step (a) is removed by blasting with $Al_2O_3$-grit.

8. The process according to claim 1, wherein the silicon layer is applied by the pack-coat process.

9. The product produced by the process of claim 1.

10. A super alloy having a protective coating layer wherein the protective coating layer comprises a Ti-Si-Ni alloy which is mainly present in the G-phase.

* * * * *